United States Patent [19]

Hjordie

[11] Patent Number: 4,966,302

[45] Date of Patent: Oct. 30, 1990

[54] SNAP LOCKING DEVICE FOR A CONTAINER WITH A COVER

[75] Inventor: Jorgen Hjordie, Kalundborg, Denmark

[73] Assignee: Lagan Plast AB, Ljungby, Sweden

[21] Appl. No.: 222,077

[22] PCT Filed: Nov. 20, 1987

[86] PCT No.: PCT/DK87/00142

§ 371 Date: Sep. 22, 1988

§ 102(e) Date: Sep. 22, 1988

[87] PCT Pub. No.: WO88/03901

PCT Pub. Date: Jun. 2, 1988

[30] Foreign Application Priority Data

Nov. 21, 1986 [DK] Denmark ..... 5579/86

[51] Int. Cl.[5] ..... B65D 41/16

[52] U.S. Cl. ..... 220/306; 220/268

[58] Field of Search ..... 220/306, 307, 266, 268

[56] References Cited

U.S. PATENT DOCUMENTS

| | | | |
|---|---|---|---|
| 4,165,018 | 8/1979 | Giggard | 220/306 X |
| 4,279,358 | 7/1981 | Jacobs | 220/306 X |
| 4,418,833 | 12/1983 | Landis | 220/306 |
| 4,431,113 | 2/1984 | Sims, Jr. | 220/306 |
| 4,444,332 | 4/1984 | Widén et al. | 220/306 |
| 4,577,756 | 3/1986 | Hennessy et al. | 220/306 X |
| 4,721,210 | 1/1988 | Lawrence et al. | 220/306 X |

*Primary Examiner*—Stephen Marcus
*Assistant Examiner*—Nova Stucker
*Attorney, Agent, or Firm*—Scully, Scott, Murphy & Presser

[57] ABSTRACT

A snap locking device for a container with a cover which is lockable to the container via a bistable loosening flange. The flange is provided on the cover or the container and is adapted to cooperate with a locking edge on the container or the cover, respectively. The bistable loosening lines, and its portions disposded between at least two weakened lines are exteriorly provided with wall reinforcements which extend axially over the bistable loosening flange. The wall reinforcements preferably extend axially over the stationary cover flange disposed in extension of the loosening flange.

4 Claims, 2 Drawing Sheets

SNAP LOCKING DEVICE FOR A CONTAINER WITH A COVER

BACKGROUND OF THE INVENTION

1. Field of the Invention:

The invention concerns a snap locking device for a container with a cover, said cover being lockable to the container via a flange which is formed on the cover or the container and which may be caused to assume a loosened and a locked position, respectively, and is adapted to cooperate with a locking edge on the container or the cover, the loosening flange, which is thus bistable, being formed with substantially vertical weakened lines.

2. Discussion of the Art:

Containers of such a type are known e.g. from the French Patent Application No. 2 377 333 which concerns the principle of locking devices comprising bistable components. However, such a simple closing arrangement for packages above a certain size is not sufficient when a package is to be used for storing both high-viscous and low-viscous substances. These may be e.g. food products, such as butter, margarine, or jam, and paint, or they may be substances for use in the medical and pharmaceutical industries.

The Danish Published Application No. 145 194 describes a container/cover structure which operates with a bistable locking flange. However, this is a structure which has been found not to be stable in transport, storage and stacking. Further, the package is not provided with a seal device, which is increasingly demanded by many buyers.

The Danish Patent Application No. 3870/83 concerns a package which is formed with seal, but constructed in such a manner as to operate upon rupture of vertical wall constrictions; however, it has been found that this form of seal has a poor control function because the wall constrictions have very little information value. The information value of the seal state is particularly essential in the pharmaceutical industries, and in the other fields of use there is a tendency for more stringent demands on the opening and closing mechanism of packages.

SUMMARY OF THE INVENTION

The object of the invention is to provide a container structure which provides a hermetically tight package in an unloaded state and also when subjected to impact or pressure, and which moreover has the property in a situation of use that the cover can temporarily be protected against impacts from the surroundings and the contents.

This object is achieved by constructing a snap locking cover device which in addition to providing a hermetically tight package, this container structure also has the advantage that the pair of weakened lines, serving as a seal device for locking the cover to the container, is provided so that the flange portion disposed between them is integral with the stationary flange portion, so that the resulting, relatively rigid edge face serves as snap locking means in which the flange may be pivoted to snap the cover onto the container. When provided with an increased radial wall thickness said flange portion will have an increased rigidity so that the snap locking effect is improved. This snap locking device is used in connection with temporary closure of the container, which is thus kept tight in case of shock impacts and possible overturning.

Further, when the snap locking means on the cover is formed with radial wall reinforcements and incorporates an additional seal means, the visual impression of the container as a so-called pilfer-proof structure is improved.

In a preferred embodiment, the cover is provided with two snap locking devices so that two pairs of weakened lines are present, each of which extends over a relatively small part of the circumference of the cover and is disposed diametrically opposite each other. This entails that each of the cover circumference parts disposed between the snap locking devices extends through a circular arc of below 180°, and this discontinuity of the circumference causes the ring tension of the cover to be reduced, which contributes to easy upward and downward movement of the locking flange; moreover, opening of the container according to the invention will not result in part of the contents being ejected because of the superpressure which is otherwise often caused upon opening of known containers. The embodiment of the cover having two snap locking devices is additionally ideal in the sense that two such devices (and thus two snap locks) are sufficient to ensure a pilfer evident cover, so that an attempt at unauthorized penetration into the container at the locking flange over an edge arc length of below 180° is impossible, without breaking one of the seals formed by the snap locking devices.

Further, the idea of the snap locking device of the invention is also that the loosening flange bistable in that it is stable in two separate positions and may be selectively provided on either the container or the cover, so that a radially protruding locking edge for engagement with said flange is correspondingly provided on the cover or the container.

As an additional closure/sealing promoting feature, the engagement faces of the container and the cover may be made conical, the conicity of the cover faces being slightly smaller than that of the container faces. This, in combination with the snap locking device of the invention, is to contribute to improved sealing at the temperary closure of the container when, in a given situation of use, the materials are to be dispensed repeatedly. In this arrangement, the cover is biased to some degree before the snap locking effect is established, which is thus to make the snap locking additionally effective when the bistable locking flanges are in a folded-up state.

In an embodiment where the bistable loosening flange is provided for the container, it will be appreciated that the opposite proportion between the conicities of the container and the cover faces is to be provided.

BRIEF DESCRIPTION OF THE DRAWINGS

The invention will be explained more fully by the following description of a preferred embodiment with reference to the drawings, in which.

DETAILED DESCRIPTION OF THE DRAWINGS

Figure 1:
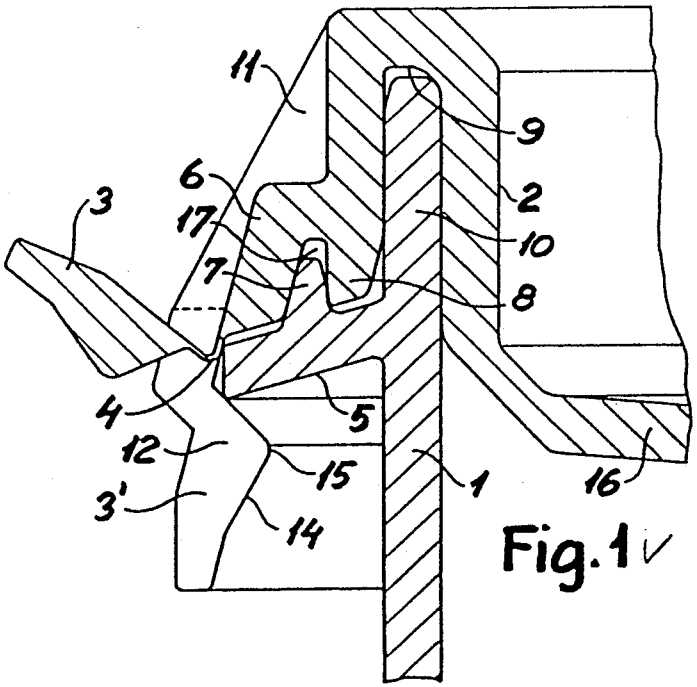
FIG. 1 is an axial sectional view illustrating the snap locking device of the container/cover structure with the loosening flange of the cover in a folded-up state.

It appears from FIG. 1 that the cover 2 is formed with a substantially planar cover face 16 merging into a sealing face 9, which is upwardly hollow in cross-section and which is adapted to receive the edge faces 10 of the container, said faces 9 and 10 thus forming the primary snap locking sealing device of the structure. The cover face is moreover connected with a stationary cover flange 6 and has also a sealing edge 8 in its direct, axially downwardly directed extension, said sealing edge 8 and the cover flange 6 defining an annular, upwardly hollow groove 17. This groove is adapted to partly receive a so-called guide rib 7, which projects upwardly from a radially outwardly protruding locking edge 5, which is connected with the container wall 1 somewhat below the container edge 10.

It will be seen from FIG. 1 that the upper engagement edge 10 of the container 1 is adapted to cooperate with the interior faces 9 of the cover 2 over a relatively long extent. This is because the cover when being applied slides down over the container edge, so that this edge is automatically cleaned of any container contents disposed thereon, and this cover type has thus a certain mechanical self-cleaning effect via the snap lock.

It is additionally illustrated how the stationary cover flange 6 is connected, via a wall constriction 4, with an extension, radial in locking position, which thus constitutes a so-called bistable loosening flange 3, which is stable in two positions and is pivotable about wall constriction 4, which is shown in its folded-up, non-locking position.

Figure 3:
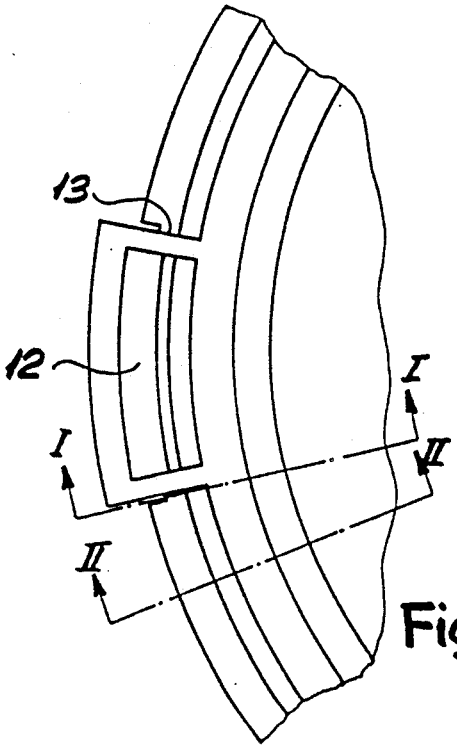
FIG. 3 is a top view of the container cover in a locked state.
Figure 4:
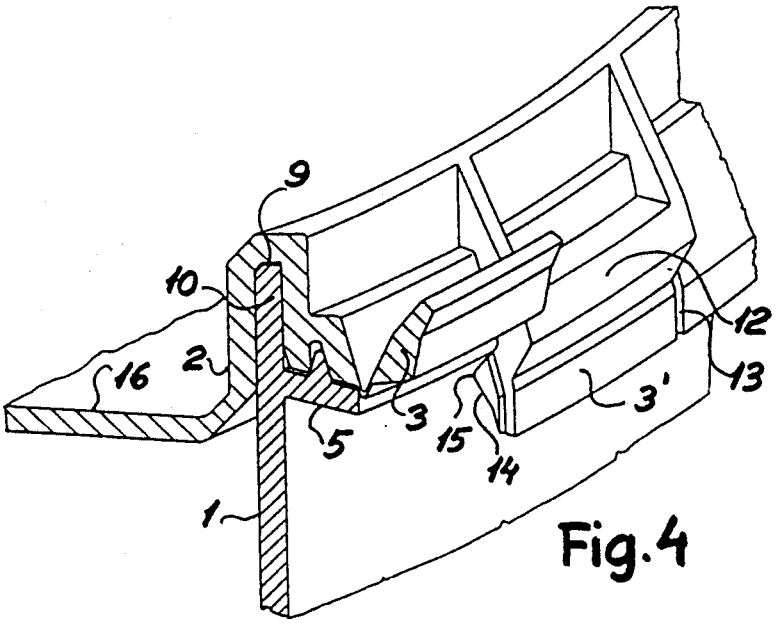
FIG. 4 illustrates the container/cover structure in a partially perspective view showing the loosening flange of the cover in its folded-up state.

The container cover is formed with wall reinforcements 11 in the form of radial thickenings preferably at two diametrically opposite points, so that the cover edge at these arc sections each constitutes so-called snap locking means (indicated by the unit 12 and comprising the elements 3', 4, 6 and 11 as well as 14 and 15), the length of these arc sections each being defined by two weakened lines 13, which are shown best in FIG. 3. When the container is to be closed, the cover is placed with its two flanges 3 in their folded-up state on the container, so that the cover assumes a position by its own weight, where the sliding face 14 of the flange 3' rests on the locking edge 5. Axial pressure impact will cause the cover to be moved further down, so that the sliding face 14 is forced radially outwardly until the boss projection 15 of the flange 3' is passed, and then the snap locking effect occurs (see also FIG. 4). The provision of the wall reinforcements 11 imparts improved radial rigidity to the snap locking devices, and this rigidity is precisely to contribute to effective, temporary closing and sealing of the cover when its bistable flange 3 is present in the folded-up state.

Figure 2:
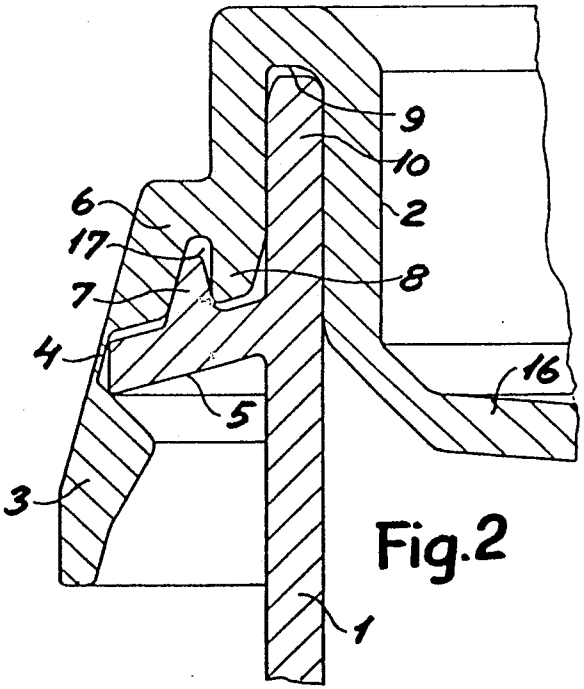
FIG. 2 is an axial sectional view of the container/cover structure with the loosening flange of the cover in its locking state.

With respect to FIGS. 1 and 2 it is readily evident that the structure described above can be modified so that the bistable locking flange is provided on the upper edge portion of the container part. Then, the stationary portions 5, 7 and 10 constitute the cover function of the container 1, the bistable and snap-locking function of the cover 2 being transferred to the container. This selection of the position of the bistable cover flange may have importance in connection with various customers' aesthetic requirements, packaging technique, storage stability, selection of handling mode and preferred allocation of the opening forces and the like.

To make the snap lock function additionally effective, the cooperating faces of the groove 17 and the guide rib 7 may be formed with mutually different conicities, the greatest being that of the guide rib. This causes the cover to be biased to some extent before locking, and this bias has moreover a sealing function. The axial rigidity has the additional effect that the cover, when being removed, has a certain "self-loosening" effect, thus ensuring easy removal of the cover in spite of the relatively strongly dimensioned snap locking device.

The above-mentioned conicity between the guide rib 7 and the groove 17 might conceivably also be provided on the engagement faces 9 and 10 of the container and the cover.

I claim:

1. A snap locking device for a container with a cover, said cover being lockable to the container, said device comprising a flange which is formed on the cover, said flange being movable between a loosened and a locked position and is adapted to cooperate with a locking edge on the container, said flange, which is thus bistable, being formed with substantially vertical weakened lines, wherein said flange portions disposed between at least two weakened lines are exteriorly provided with wall reinforcements, said wall reinforcements extending axially over the bistable flange and over a stationary cover flange disposed in extension of said flange.

2. A snap locking device according to claim 1, wherein two pairs of weakened lines are provided, said pairs being disposed diametrically opposite each other.

3. A snap locking device according to claims 1 or 2, wherein the bistable flange is provided on the cover in extension of the stationary cover flange and is adapted to engage a radially outwardly protruding locking edge on the container.

4. A snap locking device according to claim 3, wherein the container and cover have substantially vertically oriented engagement faces which are conical, and further wherein the faces of the cover have a slightly smaller conicity than the engagement faces of the container.

* * * * *

UNITED STATES PATENT AND TRADEMARK OFFICE

CERTIFICATE OF CORRECTION

PATENT NO. : 4,966,302

DATED : October 30, 1990

INVENTOR(S) : Jorgen Hjordie

It is certified that error appears in the above-identified patent and that said Letters Patent is hereby corrected as shown below:

On the Title page, Section [86]: "Sep. 22, 1988" and "Sep. 22, 1988" should read as --Aug. 22, 1988-- and --Aug. 22, 1988--

Signed and Sealed this

Seventh Day of April, 1992

*Attest:*

HARRY F. MANBECK, JR.

*Attesting Officer*

*Commissioner of Patents and Trademarks*